US008522980B2

(12) United States Patent
Burns

(10) Patent No.: US 8,522,980 B2
(45) Date of Patent: Sep. 3, 2013

(54) GLUE PELLET SEPARATOR

(75) Inventor: Robert Burns, Marysville, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 35 days.

(21) Appl. No.: 13/286,412

(22) Filed: Nov. 1, 2011

(65) Prior Publication Data

US 2013/0105367 A1 May 2, 2013

(51) Int. Cl.
*B07B 1/00* (2006.01)

(52) U.S. Cl.
USPC ..... 209/235; 209/233; 209/240; 209/241; 209/243; 209/244

(58) Field of Classification Search
USPC ..... 209/233, 235, 240–241, 243–244
See application file for complete search history.

(56) References Cited

U.S. PATENT DOCUMENTS

| | | | | |
|---|---|---|---|---|
| 3,636,864 | A * | 1/1972 | Loscialo | 100/91 |
| 4,251,354 | A * | 2/1981 | Lower | 209/240 |
| 2004/0261806 | A1 * | 12/2004 | Cagigas | 131/313 |

* cited by examiner

*Primary Examiner* — Terrell Matthews

(57) ABSTRACT

A device for supplying glue pellets to a machine includes a screen for segregating pellets according to size, a passageway for carrying into the machine pellets that do not pass through the screen, and a container for containing glue pellets at a higher elevation than an elevation of the screen, and directing away from the machine pellets that pass through the screen.

5 Claims, 1 Drawing Sheet

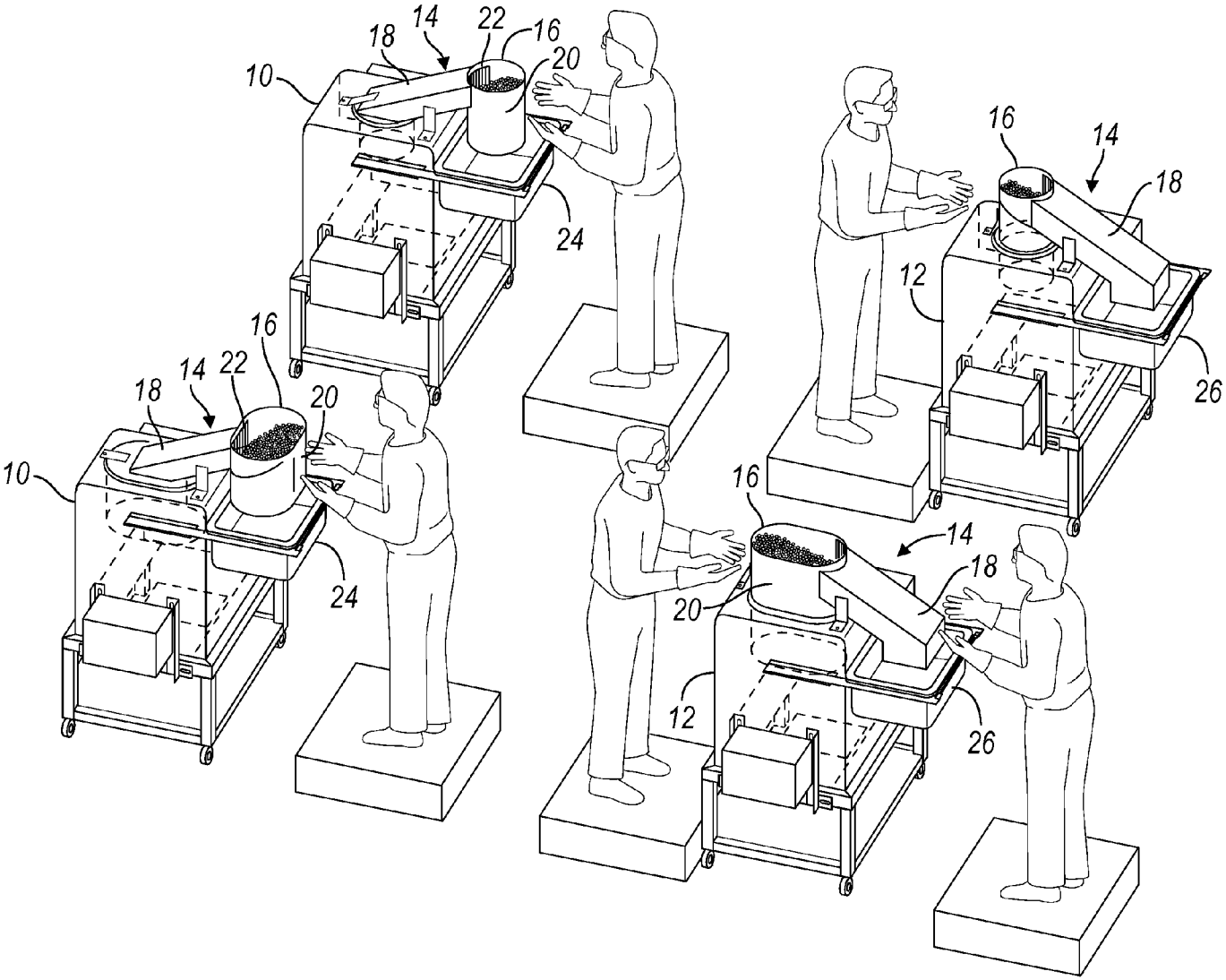
10
12
14
16
18
20
22
24
26

GLUE PELLET SEPARATOR

BACKGROUND OF INVENTION

The present invention relates generally to segregating the components of a heterogeneous mixture of glue pellets and supplying only homogenous glue pellets to a bulk hot melt glue machine.

In an automobile assembly plant or a plant where automotive components are manufactured, head impact countermeasure devices are attached by bonding to a headliner substrate using adhesive. At such a plant, however, a dry mixture comprising adhesive pellets of various materials is available for producing various bonded assemblies. For example, a heterogeneous mixture of polyolefin pellets and polyamid pellets or glue pellets of one of those materials can easily be loaded into and supplied incorrectly to a bulk adhesive system that requires pellets of the other material.

It is important that one, correct adhesive be used to bond the head impact countermeasure devices to the headliner substrate. If the incorrect adhesive were used to produce this bonded attachment, the bulk system would have to be purged and cleaned out, which may require more than eight hours to complete this corrective operation. Also, use of the wrong adhesive may create a risk that the head impact countermeasure may not remain fully attached to the headliner substrate. A failure of the bonded joint may be undesirable.

A need exists in the industry for a reliable, repeatable method or device, suitable for a high volume production environment, that ensures that a homogenous supply of glue pellets of the correct material be provided to a bulk adhesive dispensing machine, whose use is compatible with the material of the pellets being supplied. Preferably the device will segregate the correct glue pellets from foreign glue pellets, which are then available for use in another glue dispensing machine.

SUMMARY OF INVENTION

A device for supplying glue pellets to a machine includes a screen for segregating pellets according to size, a passageway for carrying into the machine pellets that do not pass through the screen, and a container for containing glue pellets at a higher elevation than an elevation of the screen, and directing away from the machine pellets that pass through the screen.

The invention includes a method for supplying glue pellets to a glue machine supporting a separator on the glue machine, using a screen of the separator with a heterogeneous mixture of glue pellets of various sizes to separate glue pellets that can pass through the screen from glue pellets that cannot pass through the screen, if the machine is to be supplied with glue pellets that are larger than a desired size, using the separator to direct pellets that cannot pass through the screen into the glue machine and directing glue pellets that pass through the screen away from the glue machine, and if the machine is to be supplied with glue pellets that are smaller than the desired size, directing pellets that pass through the screen into the glue machine and directing glue pellets that cannot pass through the screen away from the glue machine.

The device supplies glue pellets that are compatible with a bulk hot melt glue machine and prevents supplying incompatible glue pellets to the machine.

The device is simple to manufacture and minimizes the complexity of the bulk glue system. Its use prevents costly downtime due to loading the wrong adhesive into the system.

The device will separate desired glue pellets from undesired glue pellets and supply the glue pellets that are required for a particular machine depending on how the device is mounted to the bulk glue system. No controls or moving parts are required.

The scope of applicability of the preferred embodiment will become apparent from the following detailed description, claims and drawings. It should be understood, that the description and specific examples, although indicating preferred embodiments of the invention, are given by way of illustration only. Various changes and modifications to the described embodiments and examples will become apparent to those skilled in the art.

BRIEF DESCRIPTION OF DRAWINGS

The FIGURE is a perspective view showing separators used to segregate glue pellets according to size and to supply selected pellets to bulk hot melt glue machines and to send rejected pellets to bins.

DETAILED DESCRIPTION

Referring now to the drawings, there is illustrated in the FIGURE first and second bulk hot melt glue dispensing machines 10, 12, the first machine 10 requiring a supply of polyolefin glue pellets, the second machine 12 requiring a supply of polyamid pellets.

A glue pellet separator 14 includes a cylindrical canister or container 16; a chute 18, including a passageway inclined downward from an upper elevation of the container; a grid or screen 20, located in the container and preferably inclined toward the chute. Preferably narrow strips 22 of elastic, flexible plastic material supported above the entrance of the chute 18 hang downward across the depth and extend along the width of the entrance of the chute, thereby providing a flexible barrier between the chute 18 and airborne glue pellets that otherwise would bypass the separator screen 20. The strips return elastically to their position and shape following contact with such airborne glue pellets.

The grid may be of thin metal wire or plastic forming a mesh having openings about one-quarter inch square. For example, polyamid glue pellets located in container 16 can pass through the screen 20, whereas polyolefin pellets cannot pass through the screen 20. When at least two types of adhesive pellets, such as polyolefin pellets and polyamid pellets at room temperature, are combined in a heterogeneous mixture located in container 16, the pellets can be sorted according to size and shape by separator 14.

When separator 14 is used to supply polyolefin glue pellets to machines 10, container 16 is located over a bin 24 and the chute 18 communicates with a machine 10. When the separator 14 is used to supply polyolefin glue pellets to a machine 10, polyamid pellets in container 16 pass through the screen 20 and fall into bin 24. But polyolefin glue pellets, which are unable to pass through the screen 20, slide across the screen 20, past the barrier strips 22, down the chute 18 and into machine 10.

When the separator 14 is used to supply polyamid glue pellets to machines 12, container 16 is located over machine 12 and the chute 18 communicates with a bin 26. When the separator 14 is used to supply polyamid glue pellets to a machine 12, polyolefin glue pellets in container 16, which are unable to pass through the screen 20, slide across the screen 20, past the barrier strips, down the chute 18 and into bin 26. But polyamid pellets in container 16 pass through the screen 20 and fall directly into machine 12.

Glue pellets collected in bins 24, 26 can be used to supply a glue machine with which they are compatible.

The separator 14 prevents supplying incorrect glue pellets to a hot melt adhesive bulk system. The separator sorts the adhesive based on size, large from small and small from large, depending on how the separator is mounted on the machines 10, 12.

While certain embodiments of the present invention have been described in detail, those familiar with the art to which this invention relates will recognize various alternative designs and embodiments for practicing the invention as defined by the following claims.

What is claimed is:

1. A device for supplying glue pellets to a machine, comprising:

a screen for segregating pellets according to size;

a passageway for carrying into the machine pellets that do not pass through the screen;

a container for containing glue pellets at a higher elevation than an elevation of the screen, and directing away from the machine pellets that pass through the screen; and a barrier that interferes with passage of airborne pellets into the passageway, wherein the barrier comprises elastic, flexible strips supported above an entrance of the passageway and hanging downward across a depth and extending along a width of the entrance.

2. The device of claim 1, further comprising a bin located below the screen and the container for receiving and holding pellets that pass through the screen.

3. A device for supplying glue pellets, comprising:

a container for containing glue pellets;

a screen supported on the container for segregating pellets in the container according to size;

a glue machine;

a bin;

a passageway secured to the container, including an entrance located at a higher elevation than an elevation of the screen, for carrying into the machine pellets that move from the container but do not pass through the screen, the container directing into the bin pellets that pass through the screen; and a barrier that interferes with passage of airborne pellets into the passageway, wherein the barrier comprises elastic, flexible strips supported above an entrance of the passageway and hanging downward across a depth and extending along a width of the entrance.

4. A method for supplying glue pellets to a glue machine, comprising:

(a) supporting a separator on the glue machine;

(b) using a screen of the separator with a heterogeneous mixture of glue pellets of various sizes to separate glue pellets that can pass through the screen from glue pellets that cannot pass through the screen;

(c) if the machine is to be supplied with glue pellets that are larger than a desired size, using the separator to direct pellets that cannot pass through the screen into the glue machine and directing glue pellets that pass through the screen away from the glue machine; and (d) if the machine is to be supplied with glue pellets that are smaller than the desired size, directing pellets that pass through the screen into the glue machine and directing glue pellets that cannot pass through the screen away from the glue machine.

5. The method of claim 4, wherein step (b) includes using a screen having a grid that permits glue pellets smaller than the desired size to pass through the grid and prevents glue pellets larger than the desired size from passing through the grid.

* * * * *